US006578631B2

(12) United States Patent
Milne et al.

(10) Patent No.: US 6,578,631 B2
(45) Date of Patent: Jun. 17, 2003

(54) WELL LOGGING TOOL

(75) Inventors: Alex Watson Milne, Aberdeen (GB); Michael Charles Spencer, Melton Mowbray (GB)

(73) Assignee: Reeves Wireline Technologies, Ltd., Leicester (GB)

( * ) Notice: Subject to any disclaimer, the term of this patent is extended or adjusted under 35 U.S.C. 154(b) by 0 days.

(21) Appl. No.: 10/195,780

(22) Filed: Jul. 15, 2002

(65) Prior Publication Data

US 2002/0170712 A1 Nov. 21, 2002

Related U.S. Application Data

(63) Continuation of application No. 09/449,300, filed on Nov. 24, 1999, now Pat. No. 6,419,013.

(30) Foreign Application Priority Data

Nov. 28, 1998 (GB) ..... 9826017

(51) Int. Cl.[7] ..... E21B 49/00
(52) U.S. Cl. ..... 166/66; 166/383
(58) Field of Search ..... 166/66, 242.5, 166/383, 250.17, 254.2; 175/40

(56) References Cited

U.S. PATENT DOCUMENTS

| | | | | | |
|---|---|---|---|---|---|
| 4,041,780 | A | * | 8/1977 | Angehrn | 73/152.02 |
| 4,349,072 | A | * | 9/1982 | Escaron et al. | 166/254.2 |
| 4,457,370 | A | * | 7/1984 | Wittrisch | 166/254.2 |
| 4,484,626 | A | * | 11/1984 | Kerfoot et al. | 166/187 |
| 4,485,870 | A | * | 12/1984 | Walulik | 166/250.17 |
| 4,570,709 | A | * | 2/1986 | Wittrisch | 166/254.2 |
| 4,664,189 | A | * | 5/1987 | Wittrisch | 166/250.17 |
| 5,016,727 | A | * | 5/1991 | Wittrisch | 166/250.16 |
| 5,111,880 | A | * | 5/1992 | Wittrisch et al. | 166/385 |
| 5,180,011 | A | * | 1/1993 | Wittrisch | 166/254.2 |
| 5,210,533 | A | * | 5/1993 | Summers et al. | 166/250.01 |
| 5,271,472 | A | * | 12/1993 | Leturno | 175/107 |
| 5,560,437 | A | * | 10/1996 | Dickel et al. | 166/254.2 |

FOREIGN PATENT DOCUMENTS

GB 1594236 * 7/1981

* cited by examiner

*Primary Examiner*—Hoang Dang
(74) *Attorney, Agent, or Firm*—Paul & Paul

(57) ABSTRACT

A method of well logging in which the logging tool is delivered to the bottom of the well within a drill pipe and then the well is logged by withdrawing the drill pipe with the sensor portion of the logging tool protruding from the drill pipe. Following the logging operation, the logging tool is returned to the surface by reverse circulation.

3 Claims, 5 Drawing Sheets

WELL LOGGING TOOL

RELATED APPLICATIONS

This is a 37 CFR 1.53(b) continuation of U.S. non-provisional application, Ser. No. 09/449,300, filed Nov. 24, 1999 now U.S. No. Pat. 6,419,013.

BACKGROUND OF THE INVENTION

The present invention relates to a well logging method and apparatus and more particularly to a method and apparatus which enables efficient and rapid logging of a well.

In oil and gas exploration it is extremely important to produce logs of each well in order that the oil/gas producer can assess the potential output of the well and know where to perforate.

Whilst such well logging is beneficial, it can be extremely expensive due to several factors, one of which is the time taken to produce the log.

When logging a well the drilling rig is required to stand idle from its drilling operation. The hire cost of such offshore rigs is very expensive and time taken to acquire data from conventional well logging of horizontal holes can be several days.

SUMMARY OF THE INVENTION

It is an object of the present invention to provide a well logging method and apparatus which enables a well to be logged in a much shorter time period than is possible with conventional methods.

It is a further object of the present invention to provide a well logging method and apparatus which is applicable to small diameter short length logging tools.

The present invention provides a method of well logging comprising the steps of:

a) inserting a battery powered memory logging device into a well borehole at a head end of said well, said well borehole containing a drill pipe;

b) forcing said logging device to a position adjacent to the far end of said drill pipe, opposite to said head end, by means of pump pressure applied to said logging device, said pump pressure being applied along said drill pipe from said head end;

c) maintaining pump pressure on said logging device;

d) pulling back on said drill pipe over a defined length whilst maintaining said pump pressure to expose at least a portion of the logging tool containing logging sensors into the open borehole at the end of the drill pipe;

e) pulling said drill pipe through said borehole towards said head end;

f) maintaining the pump pressure to maintain the position of the logging portion of the logging device protruding from the end of the drill pipe; and g) logging the characteristics of the well with said logging device as said drill pipe is pulled through said well borehole.

Preferably the method further comprises the steps of:

h) once logging of the borehole over a required distance has been completed, reversing the pump pressure in said drill pipe such that pump pressure is applied to the end of said logging device furthest from said well head;

i) forcing said logging tool along said borehole towards said well head; and j) catching said logging tool at a position adjacent said well head.

Preferably said method further comprises k) removing said logging device from said well head and down-loading said recorded logging data.

The invention also provides a well logging tool for use with the above method, said well logging tool comprising a first portion comprising well logging sensors and a second portion comprising a retention portion, said retention portion being provided with collar means for retaining said logging device within said drill pipe.

Preferably said retention portion of said well logging tool includes means for passage of fluid through said tool.

Conveniently the well logging tool is constituted as an open hole battery memory tool.

BRIEF DESCRIPTION OF THE DRAWINGS

Embodiments of the present invention will now be described, by way of example with reference to the accompanying drawings, in which.

DETAILED DESCRIPTION OF THE INVENTION

Figure 1:
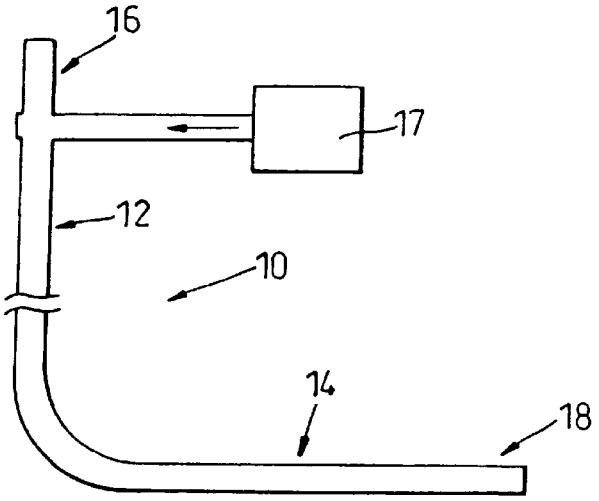
FIG. 1 shows diagrammatically a typical gas or oil well.

With reference now to the drawings, FIG. 1 shows diagrammatically a well 10. The well 10 will be typically an oil or gas well and may comprise a vertical portion 12 and possibly a horizontal portion 14. The well 10 may extend for several thousand feet.

The well 10 comprises a head end 16 and a "bottom" end 18. The term bottom end is used, but as can be seen from FIG. 1, the well 10 can extend horizontally or even turn slightly upwards. Thus, the term bottom is used to mean the opposite end of the well 10 to the head end 16.

Figure 2:
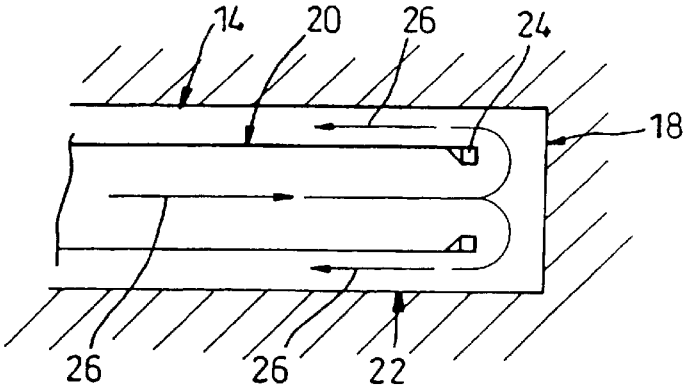
FIG. 2 shows diagrammatically a drill pipe end.

FIG. 2 shows diagrammatically the bottom end 18 of the well 10 in greater detail. A drill pipe 20 is shown which reaches to the bottom end 18 of the well 10. The sides of the well 10 are indicated at 22. The drill pipe will normally have a shoulder portion 24. As indicated by arrows 26, fluid, usually a carefully controlled mud mixture, is circulated down the central bore of the drill pipe 20 and back up the outside volume between the drill pipe 20 and the side 22 of the borehole. The fluid may be supplied by fluid pump and reservoir means 17 (FIG. 1). The supply of fluid is well known in the control/drilling of boreholes and thus the supply system will not be described further.

Figure 3:
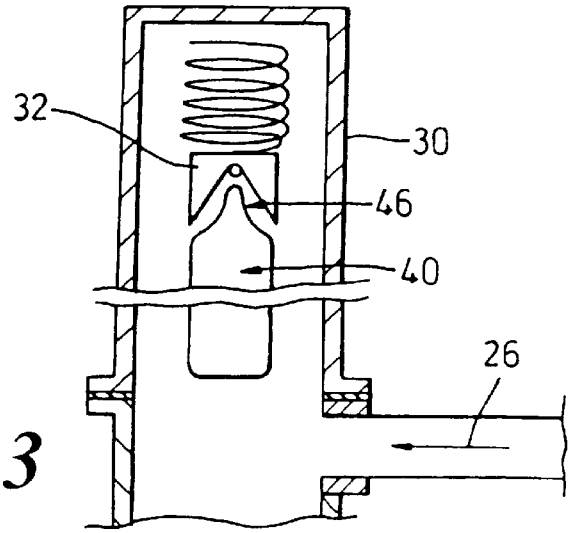
FIG. 3 diagrammatically shows the head end of the well of figure (in greater detail).

FIG. 3 shows diagrammatically the well head in greater detail. This comprises a catch portion 30 which is shown to be of undetermined length.

Figure 4:
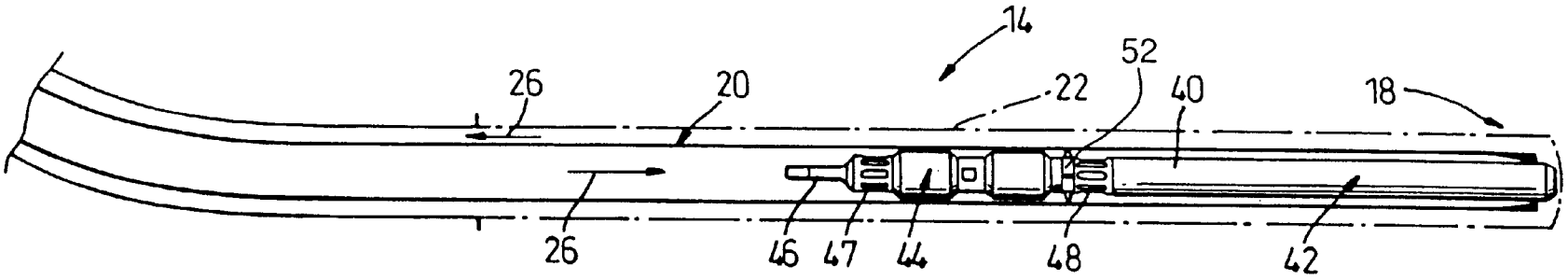
FIG. 4 shows the logging tool at a first initial position at the bottom of the drill pipe of the well of FIG. 1.
Figure 5:
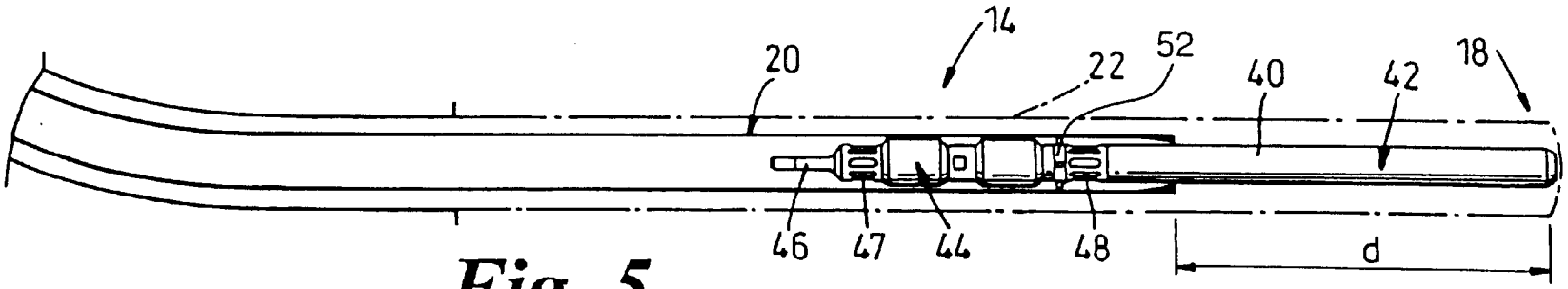
FIG. 5 shows the logging tool at a second position at the bottom of the drill pipe of the well of FIG. 1.

With reference now to FIG. 4, a typical logging tool 40 is shown positioned at the bottom end 18 of the well 10.

The logging tool 40 has been previously positioned at the head end 16 of the well 10 and then by using the pump fluid pressure in the direction of arrow 26 the logging tool 40 is forced down the drill pipe 20 until the end of the logging tool 40 reaches the bottom end 18 of the well 10 where its progress is halted as shown in FIG. 4.

In a preferred example, the logging tool 40 comprises a first portion 42 comprising well logging sensors and calliper/drive systems, and a second portion 44 including a catch portion 46 which acts as a fishing neck.

The second portion 44 preferably includes means for allowing controlled fluid flow 26 through said portion 44 with fluid passing into openings 47 and out of openings 48 or vice versa. A full description of the fluid control section of tool 40 is provided in a copending patent application having the U.S. Ser. No. 09/449,057, filed on Nov. 24, 1999, now U.S. Pat. No. 6,488,085, and thus this description is hereby incorporated by way of reference.

The method of operation is as follows and is illustrated by FIGS. 4 to 8. In FIG. 4, the logging tool 40 has been forced by fluid flow 26 to the bottom end 18.

Once the logging tool 40 has reached the bottom of the well 10, the tool 40 will be retained at the end of the drill pipe 20. The fluid pressure will then begin to build up on the end of the logging tool 40. The system is designed to allow pumping pressure to build to a predetermined limit, which in a preferred embodiment is 100 p.s.i. At this pressure a differential valve (not shown) will open in section 44 of logging tool 40 allowing the continuation of the flow 26 but now via the tool 40 (see FIG. 6).

The fluid flow pressure 26 is maintained and the drill pipe 20 is then moved back (FIG. 5) towards the well head by a distance 'd' (or greater) which causes the logging section 42 of logging tool 40 to protrude from the bottom end of the drill pipe 20.

The movement of the drill pipe 20 is by conventional means and will not be described in detail.

The free end of the interior of drill pipe 20 frictionally engages a collar 52, of per se known design, located uphole of the openings 48. Such engagement prevents the logging tool from emerging completely from the end of drill pipe 20.

Figure 6:
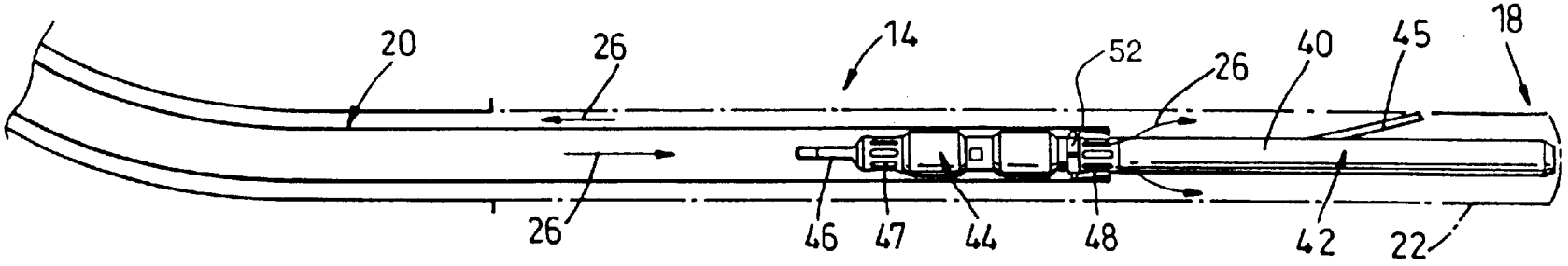
FIG. 6 shows the logging tool at a third position at the bottom of the drill pipe with the drill pipe moved away from the well end.
Figure 7:
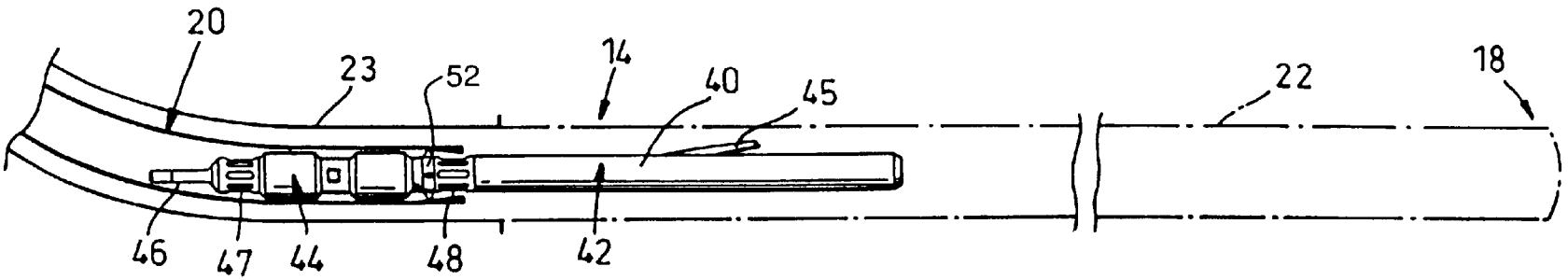
FIG. 7 shows the logging tool in a fourth position with the drill pipe moved further away from the well end.
Figure 8:
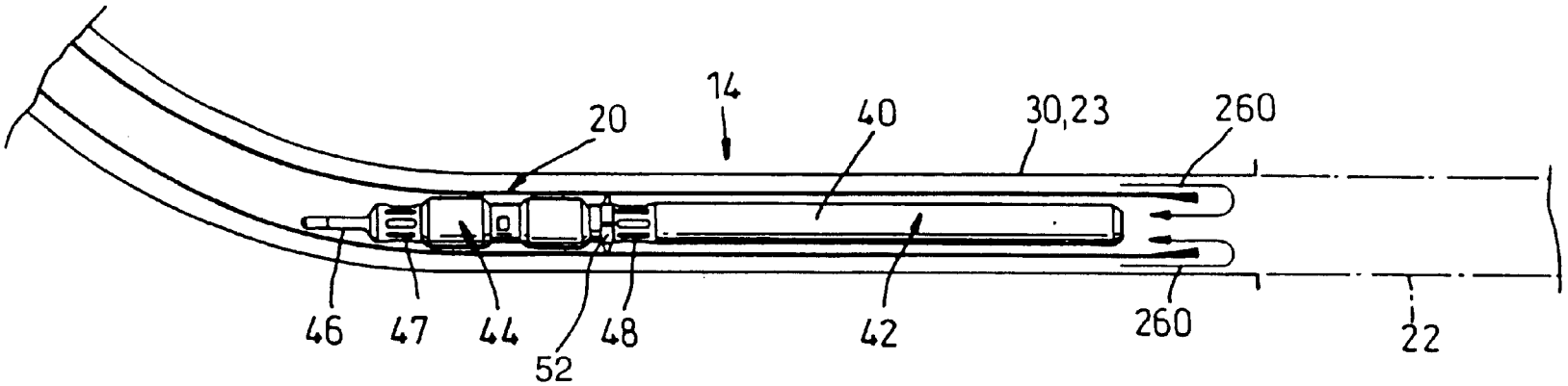
FIG. 8 shows the logging tool in a fifth position with the logging tool in a sixth position being returned to the well head end by reverse fluid pressure.

As shown in FIG. 6, calliper 45 will open when the logging section 42 of tool 40 enters the borehole 22 and then logging will commence with drill pipe 20 being pulled at a known rate towards the well head 16. Calliper control will be by using the Induction measurement and Casing Collar Locator (CCL).

Logging of the open borehole 22 will then continue as the drill pipe 20 is withdrawn until the casing shoe 23 is reached, at which stage the calliper arm 45 will close (FIG. 7), again by use of Induction measurement and Casing Collar Locator.

The logging operation is then completed with the data being recorded inside the logging tool 40.

A repeat section can be made once the calliper 45 has closed.

The mud flow 26 is then reversed as indicated by arrows 260 and this reverse mud flow will lift the tool string incorporating the logging tool 40 and the tool 40 will be received and captured in holding device 30, 23.

With appropriate reverse flow pressures, the tool 40 may be received at the well head from a depth of 10,000 ft in approximately 50 minutes and data can be downloaded in approximately 10 to 20 minutes.

The method according to the present invention has several advantages over known systems.

Firstly, by forcing the logging tool 40 to the bottom of the well 10 inside the drill pipe 20, the tool 40 is protected from any wash-out regions as it passes down the pipe 20.

When the logging tool 40 reaches the end of the drill pipe 20, it is still fully within the drill pipe 20. The drill pipe 20 is withdrawn from the logging tool 40, the logging tool 40 thereby remaining stationary relative to the well 10. The calliper 45 and the sensoring end of the logging tool 40 will therefore not have to be forced into an open bore and therefore will be protected at all times.

By use of the differential valve means, the fluid flow can be maintained during logging.

Figure 9:
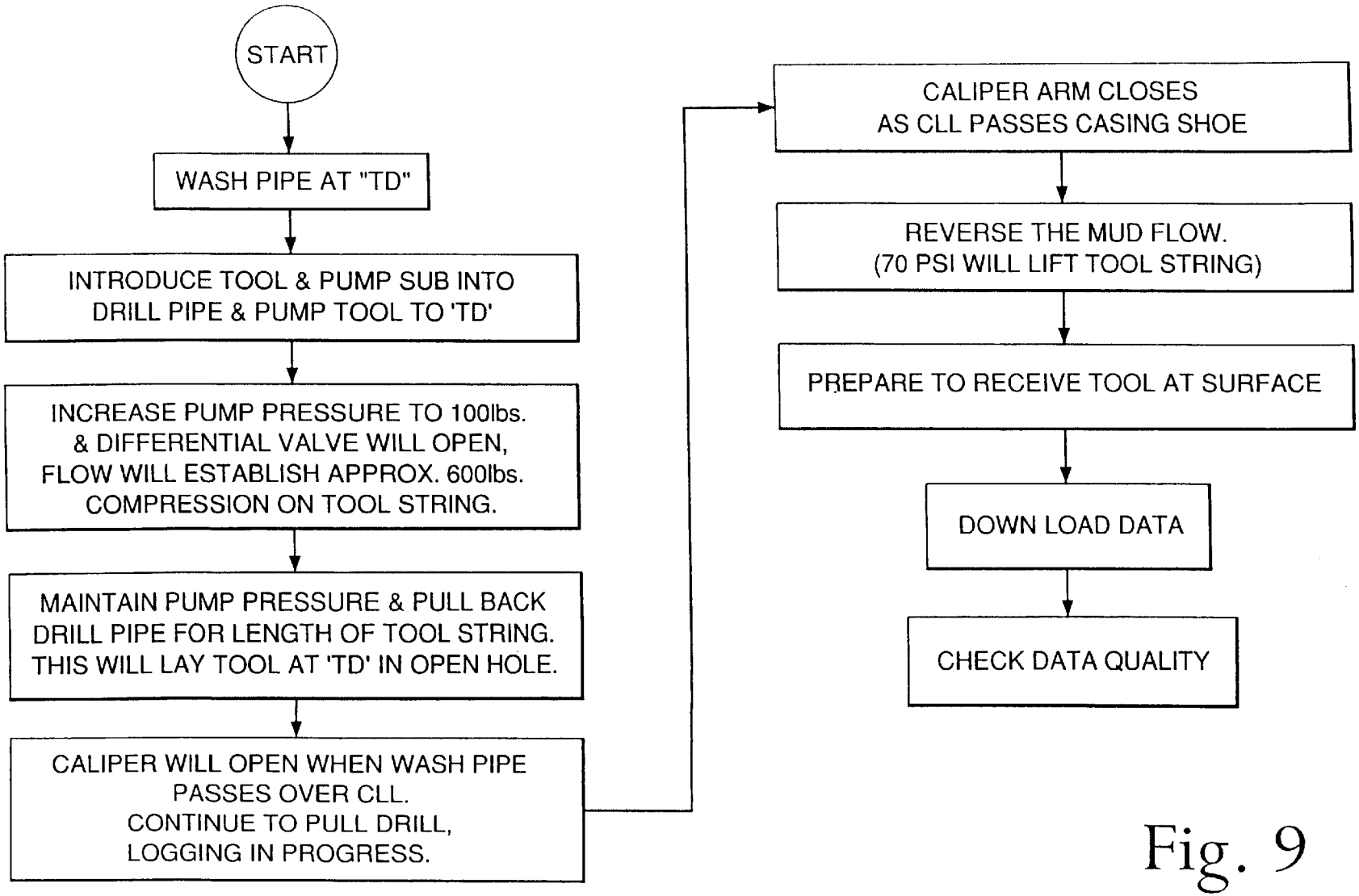
FIG. 9 is a flow diagram showing an example of a process for using the logging tool of the present invention within a drill pipe of a well.

Referring to FIG. 9, a flow diagram of an example of a process for using the logging tool 40 of the present invention within the drill pipe 20 of the well 10 is shown. FIGS. 4–8 shows the different positions of the logging tool 40 during this process. First, wash the drill pipe 20 at 'TD'. Then, introduce the logging tool 40 and pump sub into the drill pipe 20, and pump the logging tool 40 to 'TD'. Then, increase the pump pressure to 100 lbs. and the differential valve (not shown) will open. The flow will establish approximately 600 lbs. compression on the logging tool 40. Maintain the pump pressure and pull back the drill pipe 20 for length of the logging tool 40. This will lay the logging tool 40 at 'TD' in open hole. The calliper 45 will open when wash pipe passes over CCL. Continue to pull the drill when logging is in process. The calliper arm 45 closes as CCL passes the casing shoe. Now, reverse the mud flow. 70 p.s.i. will lift the logging tool 40. Then, prepare to receive the logging tool 40 at the surface. It will take approximately 30 minutes from 10,000 feet. Then, download the data, which will take approximately 2 to 3 minutes. Then, check the quality of the data.

For the example of the process described above, the control parameters are: in a 2.75' ID drill pipe; mud pressure * 5.9–tool weigh/5.9=force applied to SONDE; flow rate/internal volume per foot=tool speed; and volume pumped/internal volume per foot=distance traveled (4'/gallon).

What is claimed is:

1. An open hole battery memory well logging tool for logging a bore hole beyond a drill pipe in a well including therein a fluid, said drill pipe having a shoulder at its bottom end, comprising:

a first portion including well logging sensors, said first portion being extendable beyond said end of said drill pipe; and a second portion connected to said first portion and including a retention portion, said retention portion being provided with collar means for retaining said logging sensor first portion attached and partly protruding from said drill pipe;

wherein said retention portion permits retraction of said well logging tool within said drill pipe when said fluid in said well is reverse-circulated.

2. The well logging tool according to claim 1, wherein said retention portion of said well logging tool includes means for passage of fluid through said tool.

3. An open hole battery memory well logging tool for logging a bore hole beyond a drill pipe in a well including therein a fluid, said drill pipe having a shoulder at its bottom end, comprising:

a first portion including well logging sensors, said first portion being extendable beyond said end of said drill pipe;

a second portion connected to said first portion and including a retention portion, said retention portion being provided with collar means for retaining said logging sensor first portion attached and partly protruding from said drill pipe; and means for passage of fluid through said tool;

wherein said retention portion permits retraction of said well logging tool within said drill pipe, when said fluid in said well is reverse-circulated.

* * * * *